US008228189B2

(12) United States Patent
Naumovsky

(10) Patent No.: US 8,228,189 B2
(45) Date of Patent: Jul. 24, 2012

(54) USER-PORTABLE DEPLOYABLE RFID DEVICE AND SYSTEM

(75) Inventor: Sergey Naumovsky, Southampton, PA (US)

(73) Assignee: Key Control Holding, Inc., Houston, TX (US)

( * ) Notice: Subject to any disclaimer, the term of this patent is extended or adjusted under 35 U.S.C. 154(b) by 1383 days.

(21) Appl. No.: 11/778,030

(22) Filed: Jul. 14, 2007

(65) Prior Publication Data

US 2012/0161961 A1 Jun. 28, 2012

(51) Int. Cl.
*G08B 1/08* (2006.01)

(52) U.S. Cl. ..... 340/539.13; 340/572.1; 340/10.42

(58) Field of Classification Search ..... 340/539.13, 340/572.1–572.9, 10.42, 825.49, 10.51, 571.1, 340/10.31

See application file for complete search history.

(56) References Cited

U.S. PATENT DOCUMENTS

| | | | | |
|---|---|---|---|---|
| 6,761,637 | B2 | 7/2004 | Weston et al. | |
| 6,812,824 | B1 | 11/2004 | Goldinger et al. | |
| 6,847,892 | B2 | 1/2005 | Zhou et al. | |
| 6,859,831 | B1 | 2/2005 | Gelvin et al. | |
| 6,998,965 | B1 | 2/2006 | Luciano, Jr. et al. | |
| 7,002,473 | B2 * | 2/2006 | Glick et al. | 340/572.1 |
| 7,286,043 | B2 * | 10/2007 | Carrender et al. | 340/10.42 |
| 7,498,943 | B2 * | 3/2009 | Medve et al. | 340/572.1 |
| 7,675,422 | B2 * | 3/2010 | Stevens et al. | 340/573.1 |
| 2005/0078006 | A1 | 4/2005 | Hutchins et al. | |
| 2005/0217607 | A1 | 10/2005 | Light et al. | |
| 2006/0170553 | A1 * | 8/2006 | Bierach | 340/572.4 |
| 2006/0170565 | A1 | 8/2006 | Husak et al. | |
| 2006/0202832 | A1 | 9/2006 | Reznik et al. | |
| 2006/0208892 | A1 | 9/2006 | Ehrman et al. | |
| 2006/0267731 | A1 | 11/2006 | Chen | |
| 2007/0061041 | A1 | 3/2007 | Zweig | |
| 2008/0180322 | A1 * | 7/2008 | Islam et al. | 342/357.13 |
| 2010/0280339 | A1 * | 11/2010 | Russ | 600/301 |

* cited by examiner

*Primary Examiner* — Daniel Previl
(74) *Attorney, Agent, or Firm* — Adolph Locklar

(57) ABSTRACT

A user-portable deployable RFID device including a battery, a battery charging device connected to the battery, and an RFID reader connected to the battery configured to receive a locating signal from an RFID tag, a modem is connected to the RFID reader, the modem is configured to receive tag position data from the RFID reader and to transmit the tag position data, an antenna is connected to one or more of the RFID reader and the modem. A method of tracking a position of an entity within an entity area and a system for tracking the position of an entity within an area are also provided.

9 Claims, 7 Drawing Sheets

USER-PORTABLE DEPLOYABLE RFID DEVICE AND SYSTEM

BACKGROUND

The tracking of persons or items is of great interest in various vocations. A great deal of effort is expended implementing systems which are capable of determining the precise or approximate location of a particular person or object. Global Positioning Systems (GPS) for example utilize a plurality of satellites which send signals to earthbound receivers to allow the receivers to determine their own locations via triangulation. Land based positioning systems, for example those which utilize United States Coast Guard (USCG) broadcast towers, are also capable of permitting a receiver to determine its location with reasonable accuracy.

Known technologies for tracking often require relatively expensive and potentially bulky receiving equipment, for example a global positioning receiver, and are accordingly impractical if a large number of receivers is required for a particular application. Moreover, known systems such as those utilizing global positioning technologies are not especially conducive to smaller scale applications which may require a higher degree of tracking precision or integration with other tracking or data acquisition systems. Moreover, the constituent components of known systems are in most cases permanently fixed (or permanently in orbit in the case of GPS satellites), preventing user reconfiguration to suit the needs of a particular application.

It would be desirable to provide a tracking system which could be implemented in an area the size of which could be defined by a user. Such system should provide for the tracking of a large or small number of entities, such as persons or objects, at reasonable cost. Such system should be easily portable, configurable and reconfigurable to suit the needs of a particular application. Such system should be able to be easily integrated with other tracking or data acquisition systems.

SUMMARY

The present invention provides a user-portable deployable RFID device. The RFID device includes a battery, a battery charging device connected to the battery, and an RFID reader connected to the battery configured to receive a locating signal from an RFID tag. A modem is connected to the RFID reader. The modem is configured to receive tag position data from the RFID reader and to transmit the tag position data. One or more antennas is connected to the RFID reader and/or the modem.

The present invention further provides a method of tracking a position of an entity within an entity area. The method includes providing a deployable RFID device including a battery, an RFID reader connected to the battery configured to receive a locating signal, and a modem connected to the RFID reader. An active RFID tag is provided, and the RFID tag is connected to the entity. The deployable RFID device is deployed within the entity area. A tag locating signal is transmitted from the active RFID tag. The tag locating signal is received from the active RFID tag with the RFID reader of the RFID device. Based on the tag locating signal, a position of the RFID tag relative to the RFID device is determined and tag position data is generated.

The present invention further provides a system for tracking the position of an entity within an area. The system includes an active RFID tag configured to transmit within a range of at least 100 meters for connection with the entity.

Also provided is a user-portable deployable RFID device including a battery, an RFID reader connected to the battery configured to receive a locating signal from the RFID tag and configured to determine a position of the RFID tag relative to the deployable RFID device, and a modem connected to the RFID reader configured to receive tag position data from the RFID reader and configured to transmit the tag position data.

BRIEF DESCRIPTION OF THE DRAWING(S)

The foregoing Summary as well as the following detailed description will be readily understood in conjunction with the appended drawings which illustrate preferred embodiments of the invention. In the drawings.

DETAILED DESCRIPTION OF THE PREFERRED EMBODIMENT(S)

Figure 1:
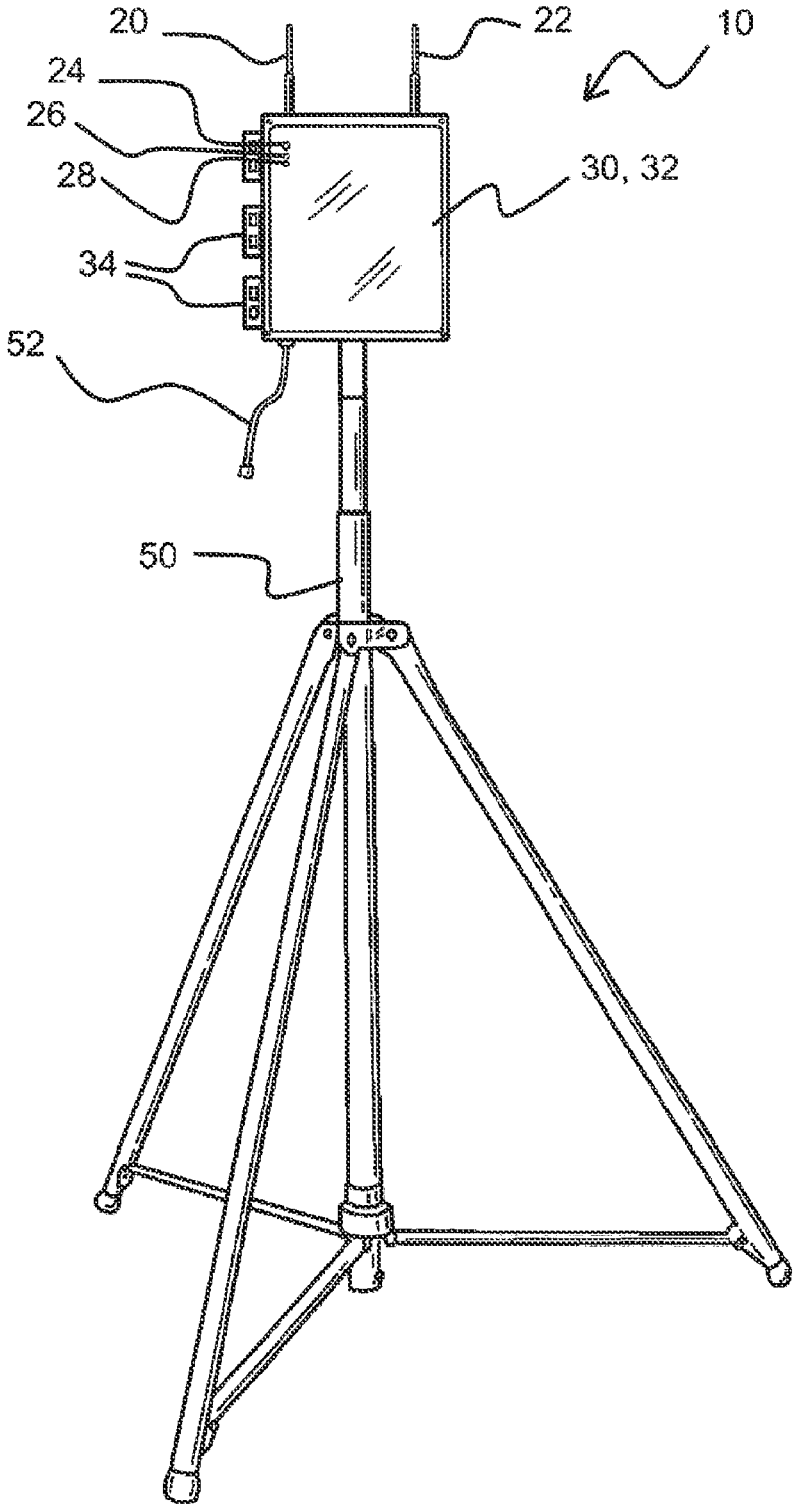
FIG. 1 is a front perspective view of a user-portable deployable RFID device according to first preferred embodiment of the present invention.

Certain terminology is used in the following description for convenience only and is not limiting. The words "right," "left," "top," and "bottom" designate directions in the drawings to which reference is made. The words "a" and "one" are defined as including one or more of the referenced item unless specifically stated otherwise. This terminology includes the words above specifically mentioned, derivatives thereof, and words of similar import. The phrase "at least one" followed by a list of two or more items, such as A, B, or C, means any individual one of A, B or C as well as any combination thereof.

The preferred embodiments of the present invention are described below with reference to the drawing figures where like numerals represent like elements throughout.

Figure 2:
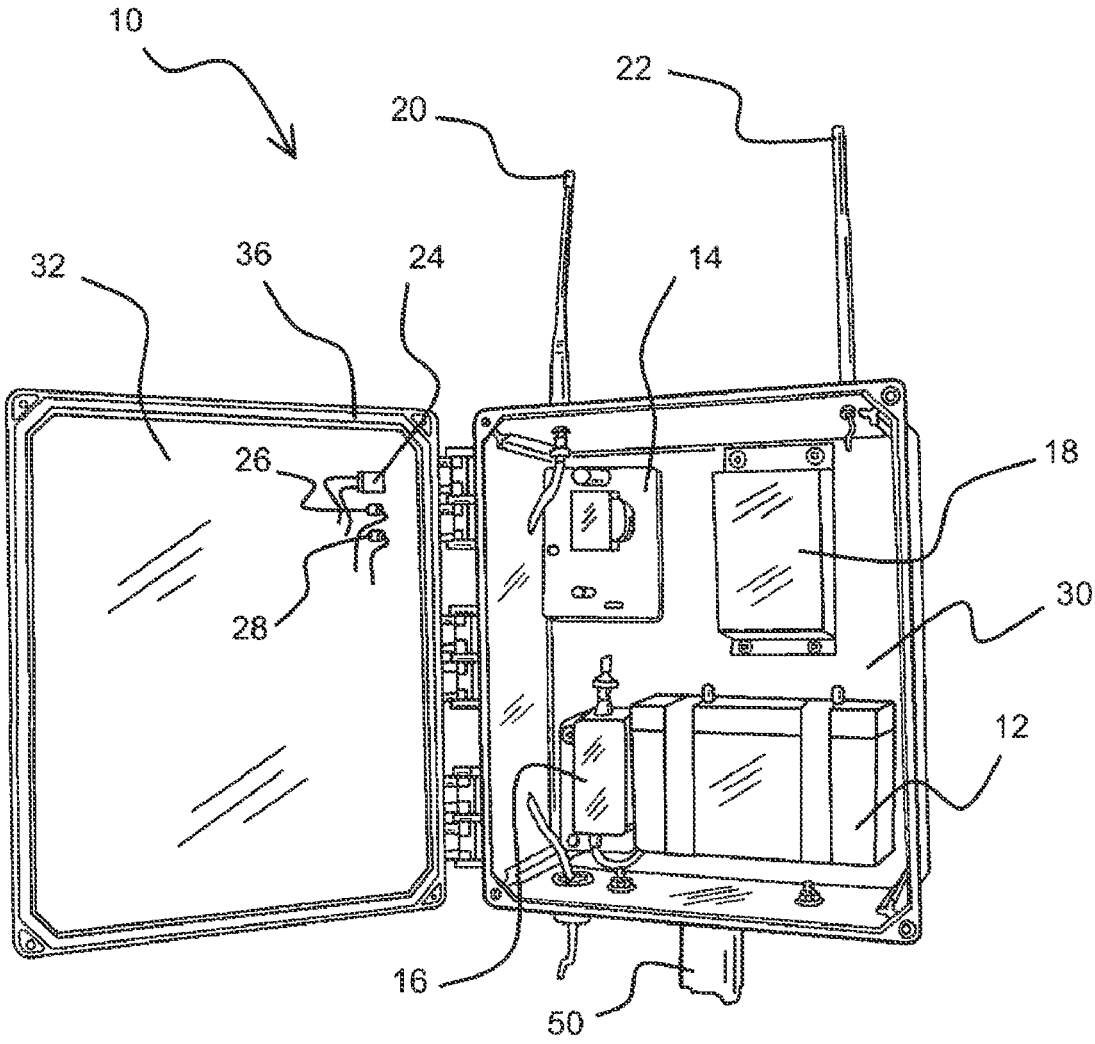
FIG. 2 is a front perspective view of the user-portable deployable RFID device of FIG. 1 with an enclosure thereof shown in an open position, connectors and wiring being partially hidden for clarity.
Figure 3:
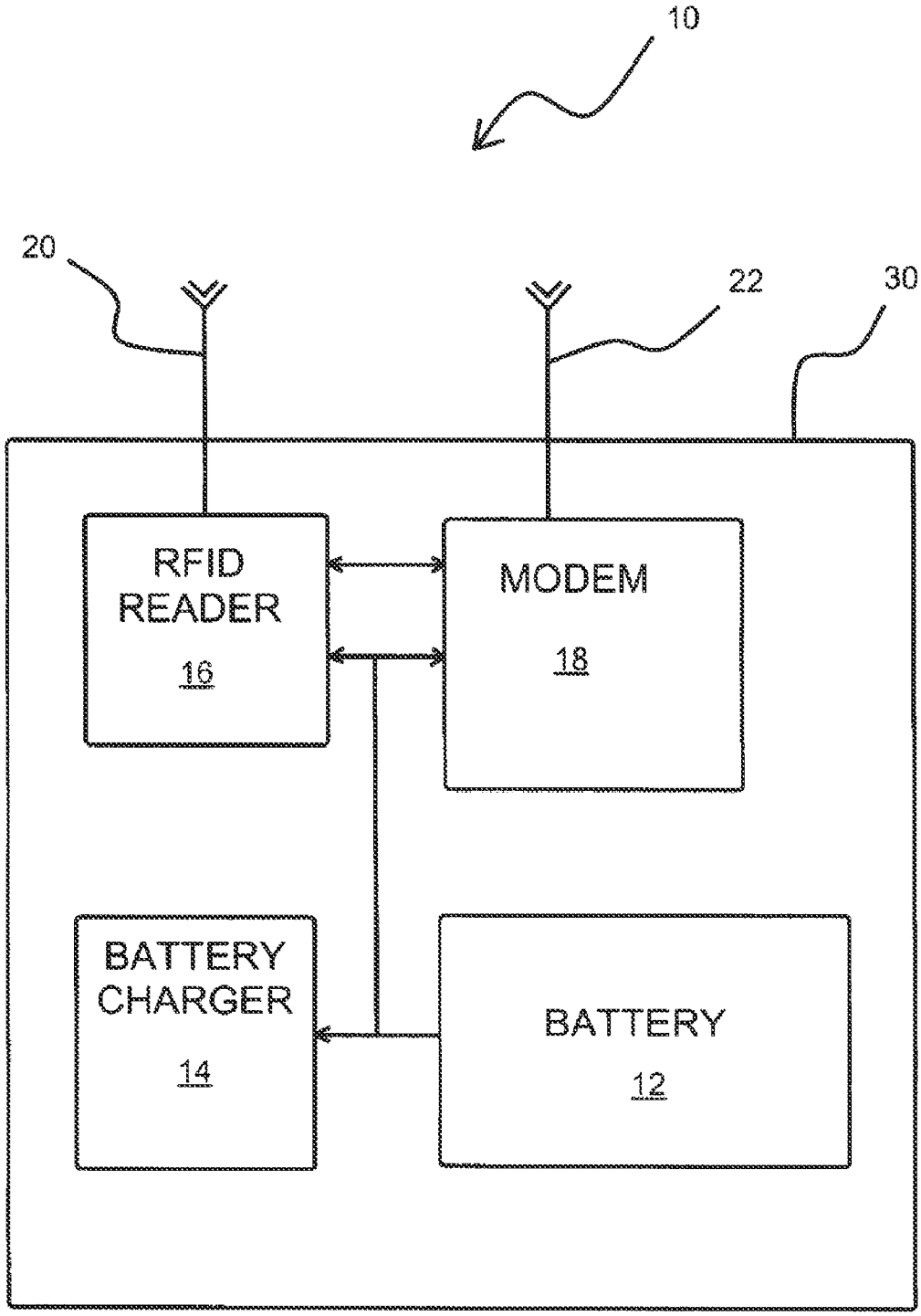
FIG. 3 is a diagrammatic illustration of the user-portable deployable RFID device of FIG. 1 showing interaction of the components thereof.

Referring to FIGS. 1-3, a user-portable deployable RFID device 10 according to a preferred embodiment of the present invention is shown. The RFID device 10 includes a battery 12 and a battery charging device 14 connected to the battery 12. An RFID reader 16 configured to receive a locating signal from an RFID tag is connected to the battery 12. A modem 18 is connected to the RFID reader 16. The modem 18 is configured to receive tag position data from the RFID reader 16 and to transmit the tag position data. A first antenna 20 is connected the RFID reader 16 for communicating with an RFID tag, and a second antenna 22 is connected to the modem 18 for communicating with other RFID devices 10 or other suitable systems.

An enclosure 30 is preferably provided which encloses the battery 12, the battery charging device 14, the RFID reader 16, and the modem 18. The enclosure 30 is preferably a water resistant polymeric housing including a door 32 and hinges 34 for opening the door 32. A circuitous gasket 36 prevents moisture from entering the inside of the enclosure. A tripod stand 50 is preferably connected to the enclosure 30 to permit the RFID device 10 to be deployed in any convenient location. The tripod stand 50 is preferably foldable and withdrawable into a compact form for carrying.

The enclosure 30, the battery 12, the RFID reader 16, the battery charging device 14, and the modem 18 preferably have a cumulative mass of less than 25 kg. The RFID device 10 including the tripod stand 50 preferably has a mass of less than 35 kg. Its light weight assures that a single user could carry and deploy the RFID device 10 without assistance from other users.

The battery 12 and the battery charging device 14 are both connected to the RFID reader 16 and the modem 18 through a power switch 24. A power status light 26 indicates when the power switch 24 is in an on position. The battery charging device 14 is preferably processor controlled and is connected to a status light 28 to indicate a charge status. The processor of the battery charging device 14 preferably includes an auto shut off feature to discontinue charging when the battery 12 is charged at a predetermined level.

Figure 4:
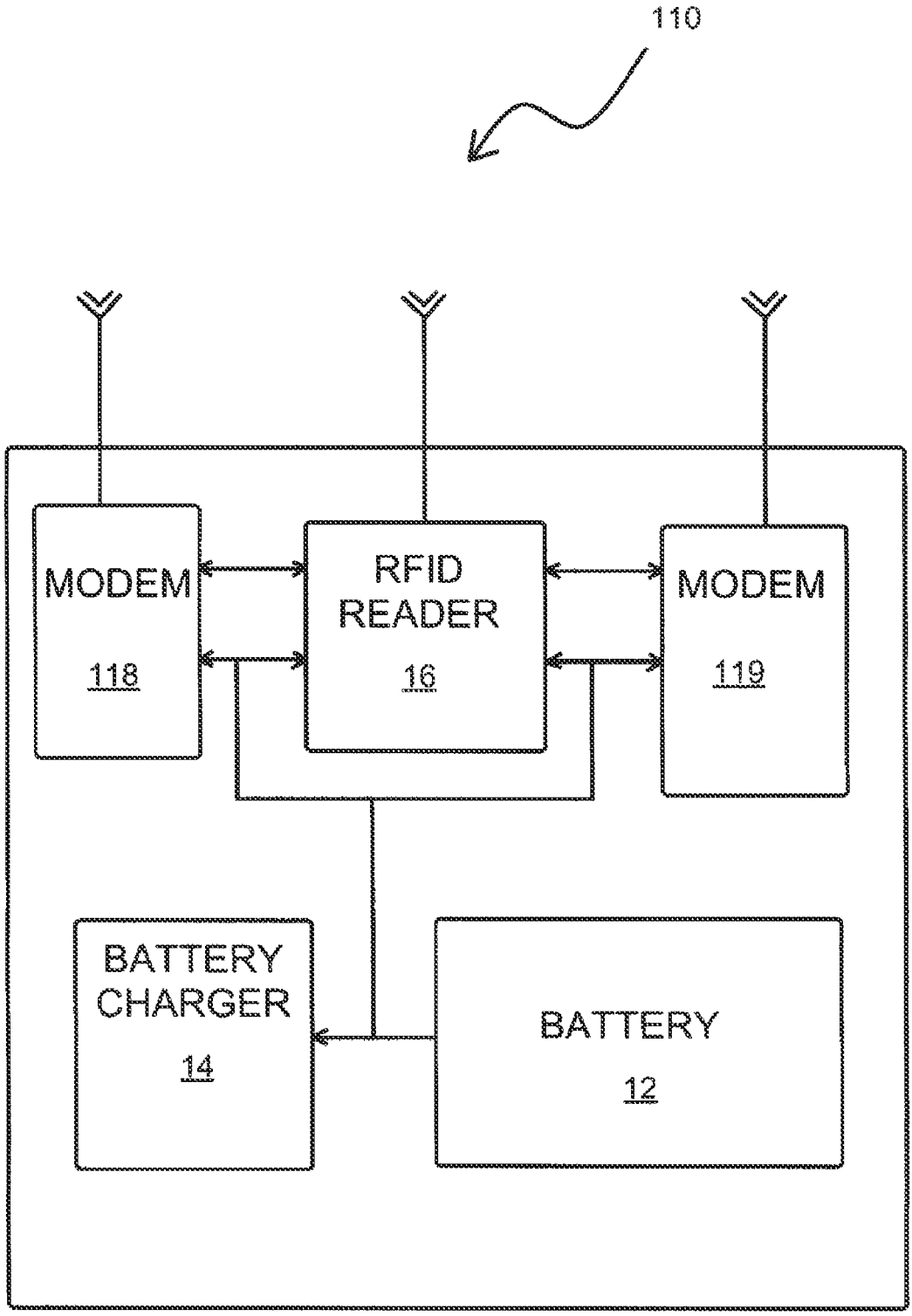
FIG. 4 is a diagrammatic illustration of an alternative user-portable deployable RFID device according to a preferred embodiment of the present invention.

The modem 18 is preferably configured to receive and transmit at one or more of 900 MHz and 2.4 GHz frequency bands. Any suitable transmission protocol may be implemented by the modem, for example 802.11x protocol. Referring to FIG. 4, an alternative user-portable deployable RFID device 110 according to a preferred embodiment of the present invention is shown in which in addition to a first modem 118, a second modem 119 with its corresponding antenna is provided. The first modem 118 is preferably configured for communication with other RFID devices 110, and the second modem 119 is preferably configured for communication with another system, for example a server system used for oversight of data retrieved from one or more of the RFID devices 110.

Figure 5:
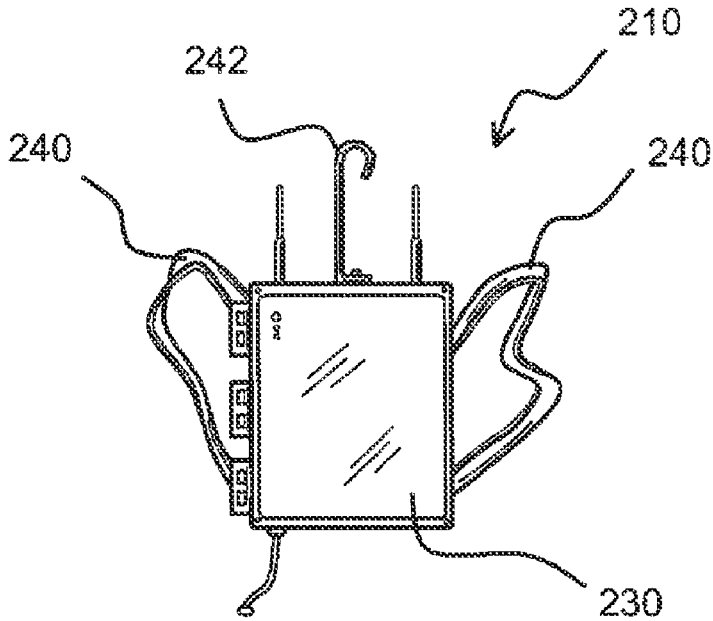
FIG. 5 is a front elevation view of another alternative user-portable deployable RFID device according to a preferred embodiment of the present invention.

Referring to FIG. 5, another alternative user-portable deployable RFID device 210 according to a preferred embodiment of the present invention is shown. The RFID device 210 includes an enclosure 230 having carrying straps 240 connected thereto useful for example to permit a user to carry the RFID device 210 in the manner of a back pack. A user may for example carry the tripod stand 50 separately and attach the tripod stand 50 to the enclosure 230 when a desired location for positioning the RFID device 210 is found. Preferably, a hook 242 is also connected to the enclosure 230 to permit the RFID device 210 to be hung in a desired location, for example on a tree branch. The hook 242 may be fixed as shown, or alternatively, foldable.

Figure 6:
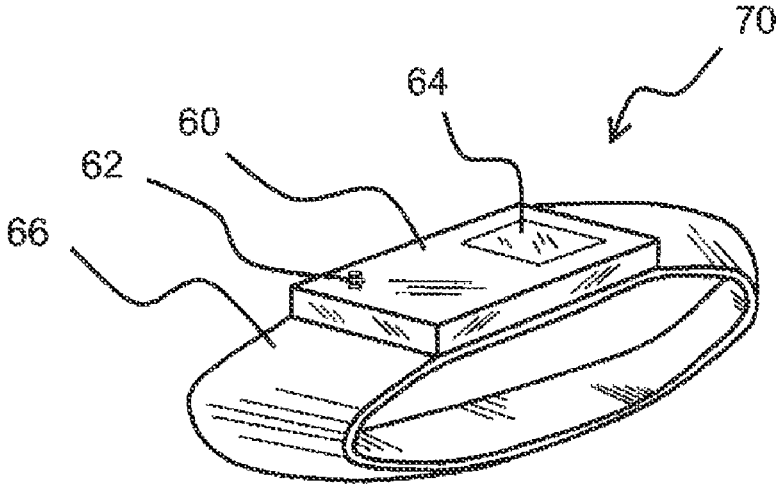
FIG. 6 is a top perspective view of an RFID tag and wristband combination according to a preferred embodiment of the invention for communication with a deployable RFID device.

Referring to FIG. 6, an RFID tag and wristband combination 70 according to a preferred embodiment of the invention is shown for communication with one or more of the deployable RFID devices 10, 110 and 210. The RFID tag and wristband combination 70 includes an RFID tag 60 attached to a wrist band 66 which is preferably an active RFID tag configured to transmit a beaconing locating signal at a predetermined interval without the need for an outside signal. The locating signal preferably includes tag identification data. The locating signal may also include additional data required for a particular application. The RFID tag 60 is preferably configured to transmit its locating signal within a range of at least 100 meters and more preferably within a range of at least 150 meters.

Figure 7:
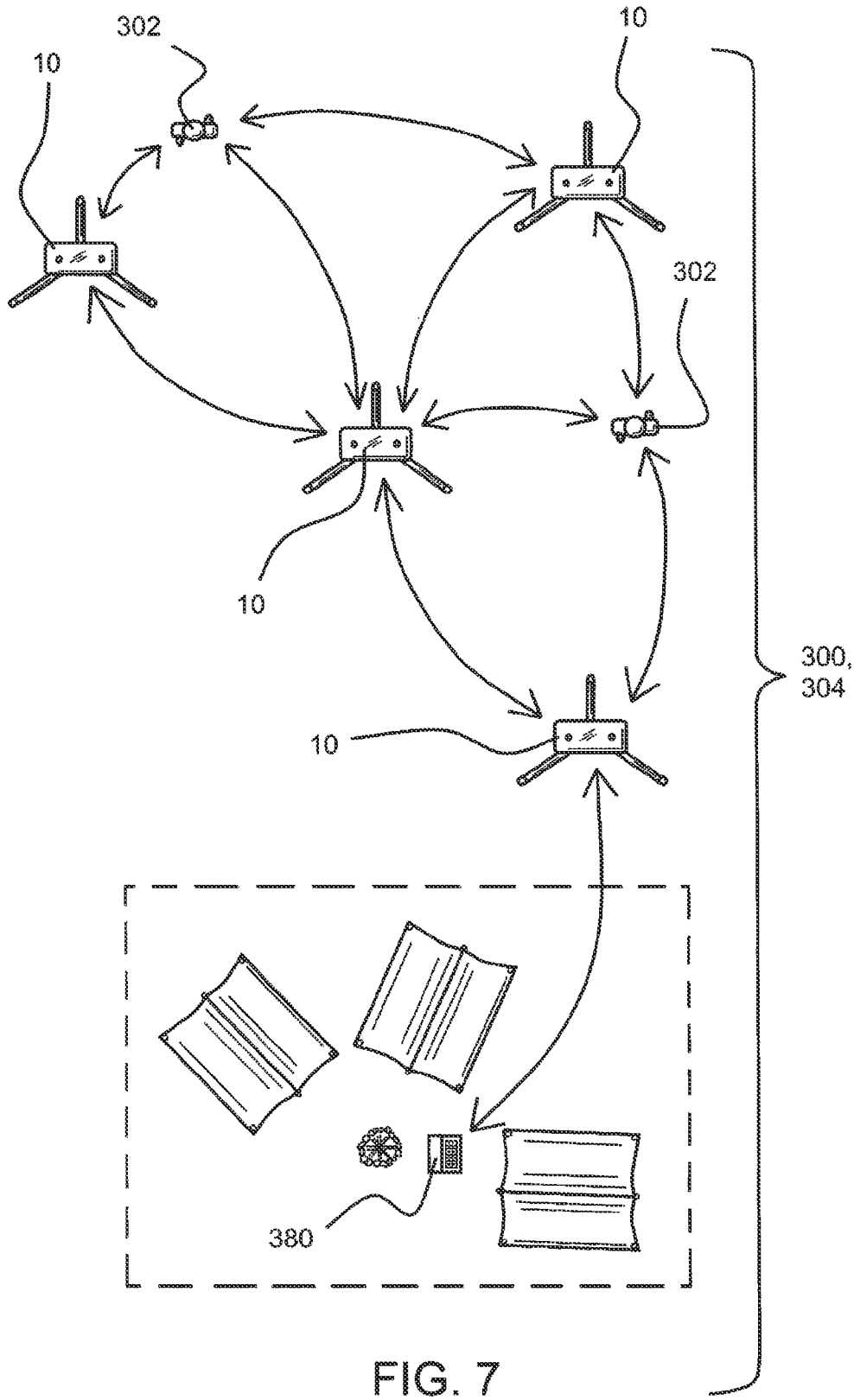
FIG. 7 is plan view of an implementation of a system for tracking the position of an entity within an area according to a preferred embodiment of the present invention.

Referring to FIG. 7, a plan view of an implementation of a system 300 for tracking the position of entities 302 within an entity area 304 according to a preferred embodiment of the present invention is shown. The entity area 304 may be within any desired environment and may be any size required for a particular application. The entities 302 may include users or objects or anything which requires tracking. The entity area 304 for example may be positioned within a campground or within a warehouse. The entities 302 for example may include children at such campground or packages in such warehouse. Moreover, the size of the entity area may be expanded or contracted during implementation of the system 300.

The system 300 preferably includes the RFID tags 60, which are preferably configured as active RFID tags with a transmission range of at least 100 meters, for connection to the entities 302. Alternatively, any suitable active RFID tags may be used. The system 300 further preferably includes one or more of the RFID devices 10, including the battery 12, the RFID reader 16 connected to the battery 12 configured to receive a locating signal from the RFID tags 60 and configured to determine a position of the RFID tags 60 relative to respective RFID devices 10. The modem 18 is configured to receive tag position data from the RFID reader 16 and to transmit the tag position data. A server system 380 is preferably provided for receiving transmissions from the modems 18 of each of the RFID devices 10. The server system 380 is preferably user-portable including for example a personal computer such as a laptop computer. Such transmissions preferably include the tag position data and RFID device position data. The server system 380 preferably includes a processor for compiling and configuring the tag position data and the RFID device position data received from the modems 18. Alternatively, the system 300 can utilize other suitable RFID devices, for example the alternative RFID devices 110, 210 described above.

Figure 8:
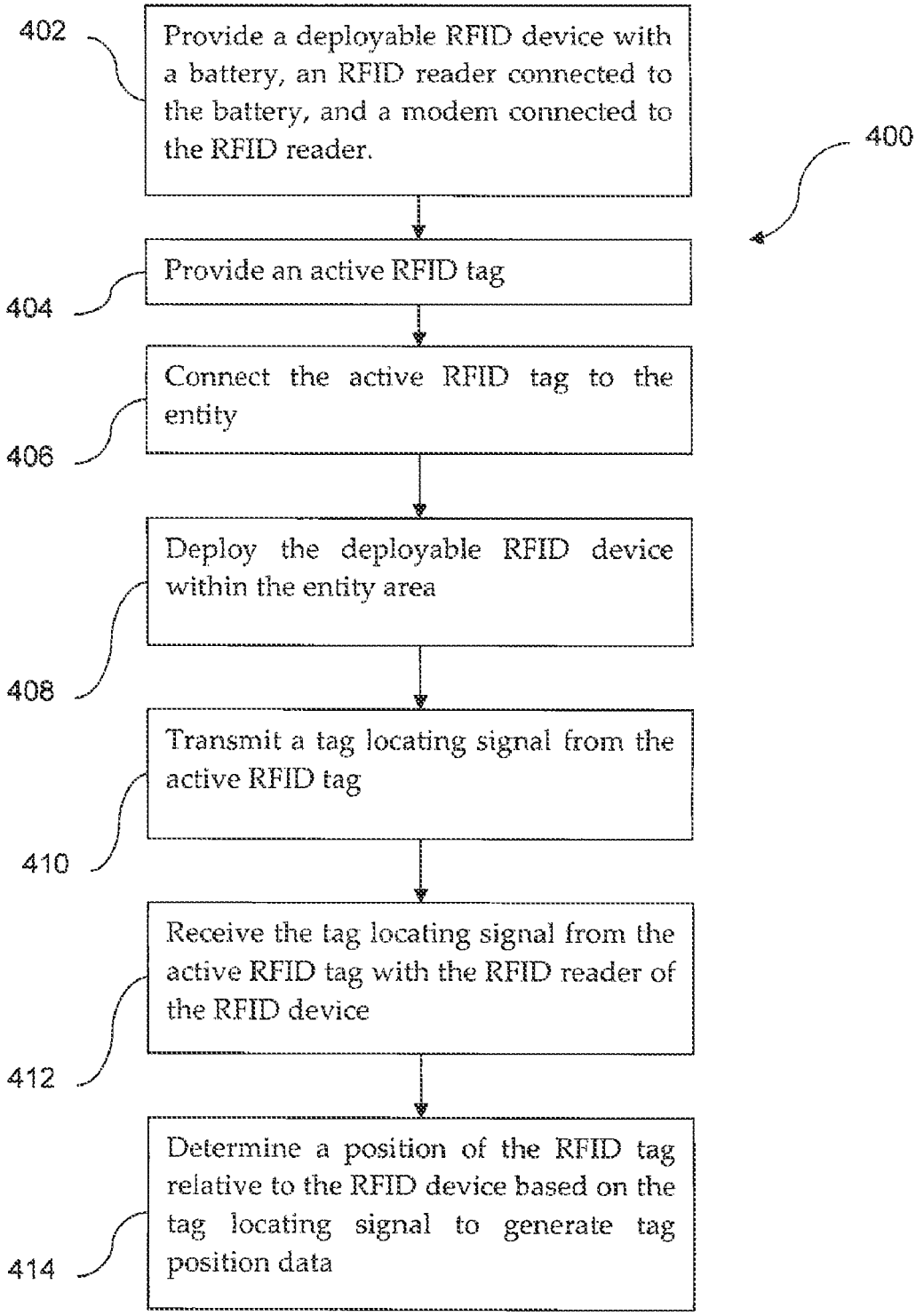
FIG. 8 is a flow diagram showing a method of tracking the position of an entity within an entity area.

Referring to FIG. 8, a method 400 of tracking a position of an entity within an entity area is shown. The method 400 is preferably practiced with the system 300 of FIG. 7 and the RFID device 10 of FIGS. 1-3, and therefore is described below as such. However, one skilled in the art will recognize that the method 400 may be practiced with other suitable systems and RFID devices, for example using the alternative RFID devices 110, 210.

The method 400 includes providing one or more deployable RFID devices 10 with the battery 12, the RFID reader 16 connected to the battery 12, and the modem 18 connected to the RFID reader 16 (step 402). The active RFID tag 10 is provided (step 404) and connected to an entity 302 (step 406). The entity 302 may include a user or an object or anything which requires tracking. The one or more deployable RFID devices 10 are deployed within the entity area 304 (step 408). A tag locating signal is transmitted from the active RFID tag 60 (step 410). The tag locating signal from the active RFID tag 10 is received with the RFID reader 16 of the one or more deployable RFID devices 10 (step 412). Based on the tag locating signal, a position of the RFID tag 60 is determined relative to the one or more RFID devices 10 to generate tag position data (step 414).

Preferably a plurality of RFID devices 10 are deployed, and a RFID device locating signal is transmitted from one or more of the RFID devices 10. One or more others of the RFID devices 10 receive the locating signal from the one or more locating signal transmitting RFID devices 10, and a position of the locating signal transmitting RFID devices 10 may be determined relative to the locating signal receiving RFID devices 10.

The server system 380 is preferably provided, and tag position data which indicates the positioning of the RFID tag 60 relative to each of the RFID devices 10 within the range of the RFID tag 60 is preferably transmitted to the server system 380 from the respective RFID devices 10 using their respective modems 18. Preferably, RFID device position data, which indicates the positioning of the RFID devices 10 relative to other ones of the RFID devices 10 or relative to the server system 380, is also transmitted to the server system 380. In such manner, the server system 380 may analyze such data to determine accurate positioning of the RFID tags 60.

The tag position data, which indicates positioning of the RFID tag 60 relative to the one or more RFID devices 10, preferably includes at least a distance measurement of the RFID tag 60 relative to one of the RFID devices 10. Preferably, the tag position data is provided by a plurality of the RFID devices 10 within the transmission range of the RFID tag 60 such that a plurality of distance measurements of the RFID tag 60 relative to respective ones of the RFID devices 10 may be used, preferably by the server system 380, to determine an accurate position of the RFID tag 60. Preferably, at least three RFID devices 10 are provided within a range of the RFID tags 60 within the entity area 304. Accordingly, the tag position data, including a relative distance measurement from each of the three RFID devices 10, may be used to determine an actual position of the RFID tag 60 by triangulation, if the actual positions of the RFID devices 10 are known.

The tag position data and RFID device position data may be transmitted directly to the server system 380 from each of the RFID devices 10, or alternatively, relayed from one or more of the RFID devices 10 through one or more other RFID devices 10 which are nearer to the server system 380, for example when one or more of the RFID devices 10 is out of the transmitting or receiving range of the server system 380. The server system 380 is preferably configured to perform analysis of the tag position data and RFID device position data for display to a user, for example to determine an actual position of the RFID tag 60 or the RFID device 10 from relative position data including the tag position data and/or RFID device position data.

The method 400 preferably further includes the transmission of an indicating signal from the RFID device 10 to the RFID tag 60 when the RFID tag 60 exceeds a predetermined distance from the RFID device 10 as determined by the RFID reader 16. Alternatively, an indicating signal may be transmitted when it is determined that a triangulated position of the RFID tag 60 is outside of a predetermined two-dimensional area defined by at least three RFID devices 10. The transmission of the indicating signal is preferably made by the modem 18. The RFID tag 60 is preferably configured to emit a sound using a speaker 62 and/or configured to display a light or other visual display using a screen 64 in response to the indicating signal to notify the entity 302 or those persons near the entity 302 that the predetermined distance or two-dimensional area has been exceeded. In addition to or alternative to the indicating signal sent to the RFID tag 60, an indicating signal may be sent by the RFID device 10 to the server system 380 to notify that the entity 302 has exceeded a predetermined distance or two-dimensional area.

The method 400 preferably also includes connecting the active RFID tag 60 to a user and carrying and positioning of the RFID device 10 by the user. The method 400 preferably further includes connecting a power supply to the battery charging device 14 and charging the battery 12 with the battery charging device 14, for example via a charging line 52 connected to the battery charging device 14.

While the preferred embodiments of the invention have been described in detail above, the invention is not limited to the specific embodiments described above, which should be considered as merely exemplary. Further modifications and extensions of the present invention may be developed, and all such modifications are deemed to be within the scope of the present invention as defined by the appended claims.

What is claimed is:

1. A method of tracking a position of at least one entity within an entity area, the method comprising:

providing at least one deployable RFID device, the at least one deployable RFID device comprising:

a battery;

an RFID reader connected to the battery configured to receive a locating signal; and at least one modem connected to the RFID reader;

providing at least one active RFID tag;

connecting the at least one active RFID tag to the at least one entity;

deploying the at least one deployable RFID device as a first deployable RFID device and a second deployable RFID device within the entity area;

transmitting a tag locating signal from the at least one active RFID tag;

receiving the tag locating signal from the at least one active RFID tag with the RFID reader of the at least one RFID device;

based on the tag locating signal determining a position of the RFID tag relative to the at least one RFID device to generate tag position data;

transmitting a RFID device locating signal from the first deployable RFID device;

receiving the RFID device locating signal from the first deployable RFID device with the second deployable RFID device; and determining a position of the first deployable RFID device relative to the second RFID device based on the RFID device locating signal received from the first deployable RFID device with the second deployable RFID device.

2. The method of claim 1, further comprising providing a server system;

determining the position of the RFID tag relative to the at least one RFID device to generate the tag position data using the RFID reader; and transmitting the tag position data to at least one of the server system and another of the at least one RFID device using the at least one modem.

3. The method of claim 1, wherein the determining the position of the RFID tag comprises at least determining the distance of the RFID tag from the at least one deployable RFID device, and the method further comprising transmitting an indicating signal from the at least one deployable RFID device to the RFID tag when the RFID tag exceeds a predetermined distance from the at least one deployable RFID device.

4. The method of claim 1, wherein the connecting the at least one active RFID tag to the at least one entity comprises connecting the at least one active RFID tag to at least one user, and wherein the deploying of the at least one deployable RFID device comprises carrying and positioning of the at least one deployable RFID device by the at least one user.

5. The method of claim 1, further comprising:

providing the at least one deployable RFID device with a battery charging device connected to the battery;

providing the at least one deployable RFID device with an enclosure connected to and enclosing the battery, the RFID reader, the battery charging device, and the at least one modem;

connecting a power supply to the battery charger; and charging the battery with the battery charger.

6. A method of tracking a position of at least one entity within an entity area, the method comprising:

providing a server system;

providing at least one deployable RFID device, the at least one deployable RFID device comprising:

a battery;

an RFID reader connected to the battery configured to receive a locating signal; and at least one modem connected to the RFID reader;

providing at least one active RFID tag;

connecting the at least one active RFID tag to the at least one entity;

deploying the at least one deployable RFID device as a plurality of deployable RFID devices within the entity area;

transmitting a tag locating signal from the at least one active RFID tag;

receiving the tag locating signal from the at least one active RFID tag with the RFID reader of the at least one RFID device;

based on the tag locating signal determining a position of the RFID tag relative to the at least one RFID device to generate tag position data; and relaying the tag position data of the RFID tag from a first one of the plurality of RFID devices through at least a second one of the plurality of RFID devices to the server system, wherein the tag position data comprises at least a distance measurement from the RFID tag to the first one of the plurality of RFID devices.

7. A method of tracking a position of at least one entity within an entity area, the method comprising:

providing at least one server system;

providing at least one deployable RFID device, the at least one deployable RFID device comprising:

a battery;

an RFID reader connected to the battery configured to receive a locating signal; and at least one modem connected to the RFID reader;

providing at least one active RFID tag;

connecting the at least one active RFID tag to the at least one entity;

deploying the at least one deployable RFID device as a first deployable RFID device, a second deployable RFID device, and a third deployable RFID device within the entity area;

transmitting a tag locating signal from the at least one active RFID tag;

receiving the tag locating signal from the at least one active RFID tag with the RFID reader of the at least one RFID device;

based on the tag locating signal determining a position of the RFID tag relative to the at least one RFID device to generate tag position data;

transmitting a RFID device locating signal from the first deployable RFID device using the at least one modem of the first deployable RFID device;

receiving the RFID device locating signal from the first deployable RFID device with the second deployable RFID device using the at least one modem of the second deployable RFID device;

determining a position of the first deployable RFID device relative to the second RFID device based on the RFID device locating signal received from the first deployable RFID device with the second deployable RFID device to generate RFID device position data; and relaying the RFID device position data of the first deployable RFID device from the second deployable RFID device through the third deployable RFID device to the at least one server system.

8. A method of tracking a position of at least one entity within an entity area, the method comprising:

providing at least one deployable RFID device, the at least one deployable RFID device comprising:

a battery;

an RFID reader connected to the battery configured to receive a locating signal; and at least one modem connected to the RFID reader;

providing at least one active RFID tag;

connecting the at least one active RFID tag to the at least one entity;

deploying the at least one deployable RFID device as a plurality of deployable RFID devices comprising a first deployable RFID device, a second deployable RFID device, and a third deployable RFID device within the entity area;

transmitting a tag locating signal from the at least one active RFID tag;

receiving the tag locating signal from the at least one active RFID tag with the RFID reader of the first deployable RFID device, the second deployable RFID device and the third deployable RFID device; and based on the tag locating signal, determining a position of the RFID tag relative to the first deployable RFID device, the second deployable RFID device and the third deployable RFID device.

9. A method of tracking a position of at least one entity within an entity area, the method comprising:

providing at least one deployable RFID device, the at least one deployable RFID device comprising:

a battery;

an RFID reader connected to the battery configured to receive a locating signal; and at least one modem connected to the RFID reader;

providing at least one active RFID tag;

connecting the at least one active RFID tag to the at least one entity;

deploying the at least one deployable RFID device within the entity area;

transmitting a tag locating signal from the at least one active RFID tag;

receiving the tag locating signal from the at least one active RFID tag with the RFID reader of the at least one RFID device; and based on the tag locating signal determining a position of the RFID tag relative to the at least one RFID device to generate tag position data;

wherein the providing the at least one deployable RFID device comprises providing at least three deployable RFID devices, wherein the determining the position of the RFID tag comprises triangulating the position of the RFID tag relative to the at least three deployable RFID devices, and the method further comprises transmitting an indicating signal to the at least one active RFID tag when the RFID tag moves outside of a predetermined two-dimensional area.

* * * * *